US005494414A

United States Patent [19]

Steinhart et al.

[11] Patent Number: 5,494,414

[45] Date of Patent: Feb. 27, 1996

[54] VERTICAL SHAFT PRESSURE WASHER COUPLING ASSEMBLY

[75] Inventors: Eric E. Steinhart, Bellevue; Daniel C. Ertl, Dyersville, both of Iowa

[73] Assignee: Mi-T-M Corporation, Peosta, Iowa

[21] Appl. No.: 348,626

[22] Filed: Dec. 2, 1994

[51] Int. Cl.[6] ..... F04B 53/22

[52] U.S. Cl. ..... 417/360; 417/364

[58] Field of Search ..... 417/360, 364; 403/23, 164

[56] References Cited

U.S. PATENT DOCUMENTS

| | | | |
|---|---|---|---|
| 2,849,958 | 9/1958 | Mitchell | 417/364 |
| 3,847,504 | 11/1974 | Martin | 417/360 |
| 4,272,224 | 6/1981 | Kabele | 417/364 |
| 4,611,529 | 9/1986 | Stricker | 417/360 |
| 4,684,330 | 8/1987 | Andersson et al. | 417/360 |

*Primary Examiner*—Richard A. Bertsch
*Assistant Examiner*—Roland G. McAndrews, Jr.
*Attorney, Agent, or Firm*—Henderson & Sturm

[57] ABSTRACT

An apparatus for coupling a vertically oriented internal combustion engine to an axial piston pump for use with pressure washers. Attached to the lower surface of the engine is a circular flange with inwardly extending ribs which supports a pump attachment unit. The pump attachment unit is comprised of a series of concentric annular rings for an oil seal and thrust bearing and for pump attachment. The pump drive shaft slides over and is keyed to the engine drive shaft and has an annular lip for mating with the thrust bearing. The pump wobble plate is bolted to the lower end of the pump drive shaft.

3 Claims, 3 Drawing Sheets

Fig. 3
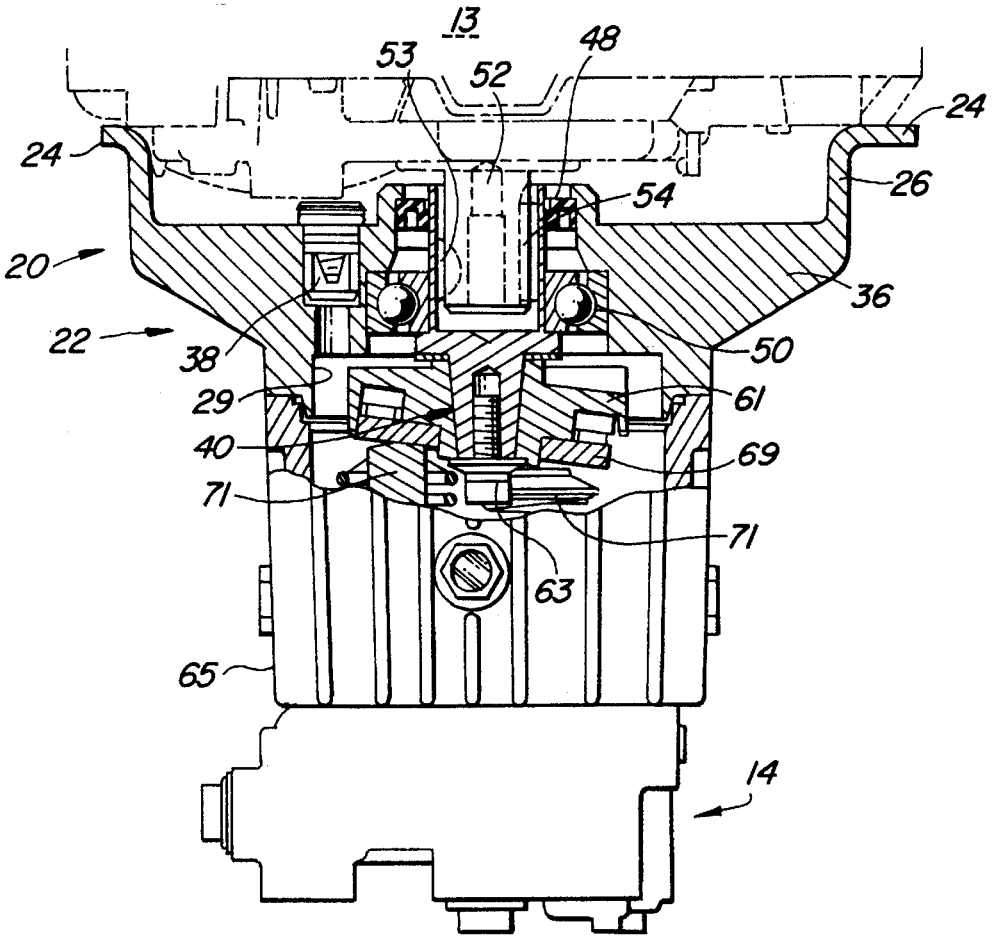
Fig. 6
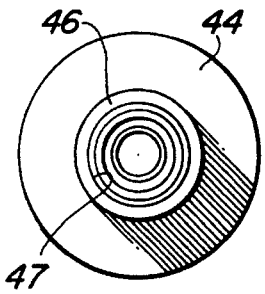
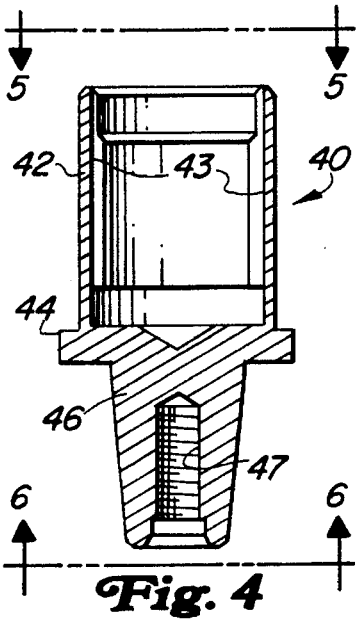
Fig. 4
Fig. 5
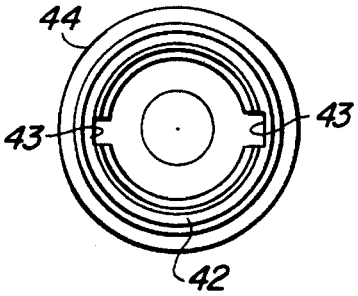

Fig. 8
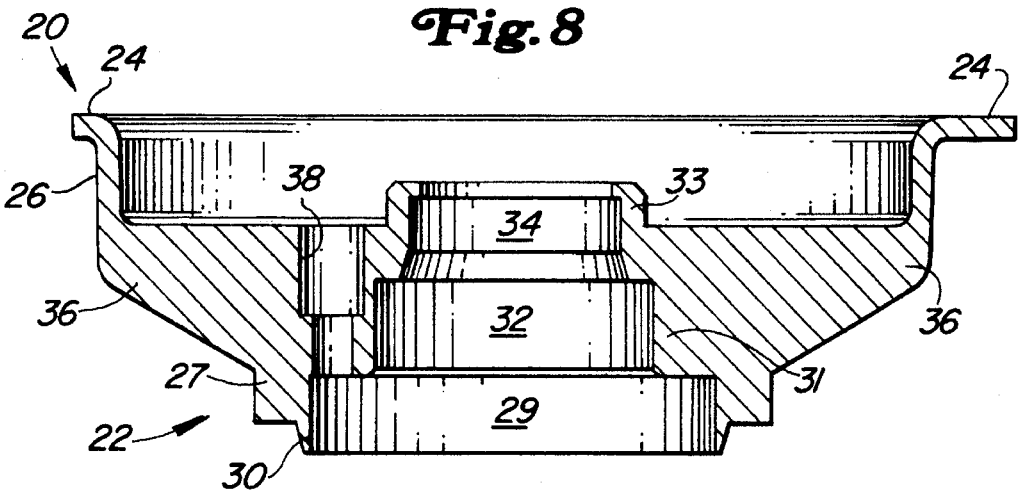
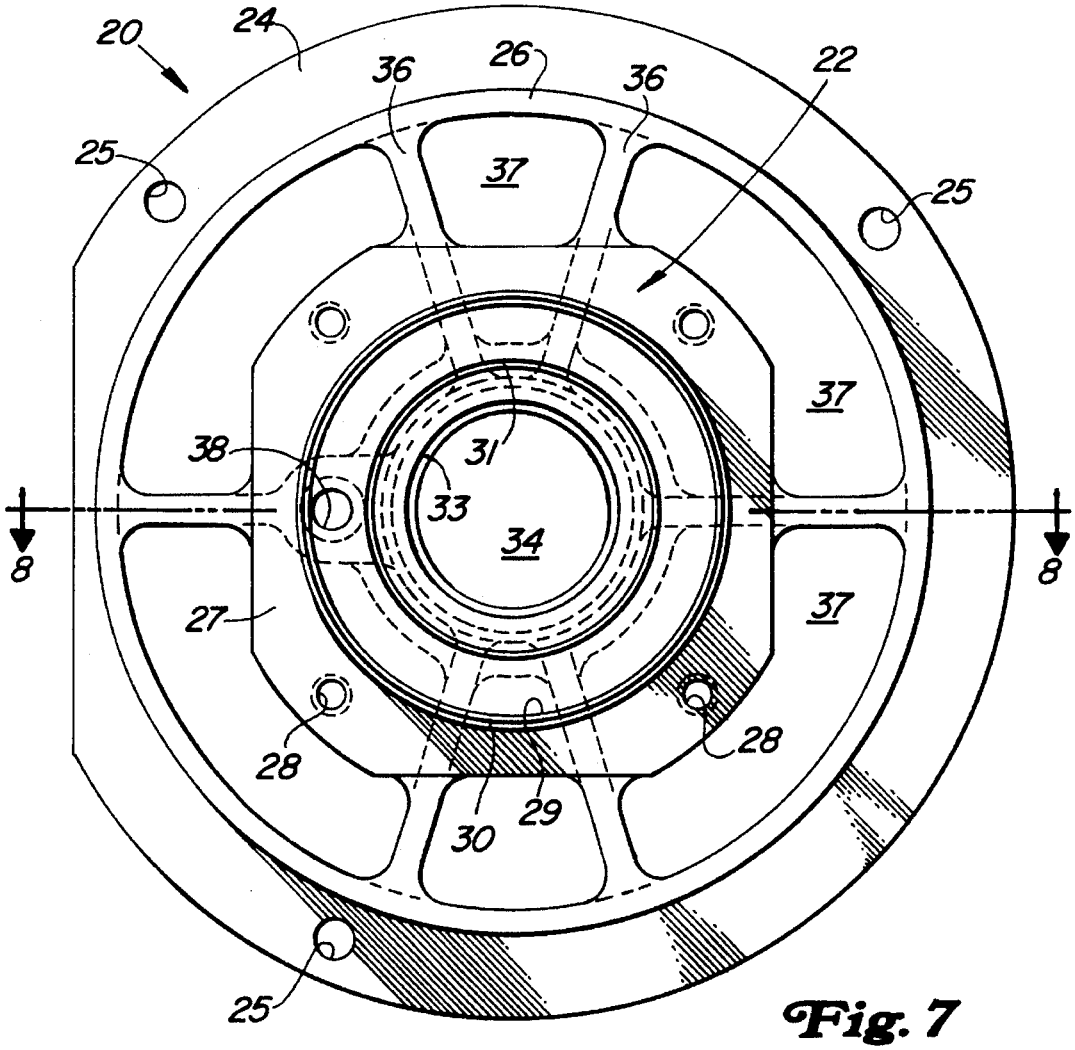
Fig. 7

VERTICAL SHAFT PRESSURE WASHER COUPLING ASSEMBLY

TECHNICAL FIELD

This invention relates to pressure washers utilizing axial piston pumps driven by internal combustion engines, and more particularly to an apparatus for coupling an internal combustion engine with a vertical drive shaft orientation to an axial piston pump.

BACKGROUND ART

Disclosure of the Invention

The present invention discloses an apparatus for coupling a vertically oriented internal combustion engine to an axial piston pump for use with pressure washers. Attached to the lower surface of the engine is a circular flange with inwardly extending ribs which supports a pump attachment unit. The pump attachment unit is comprised of a series of concentric annular rings for an oil seal and thrust bearing and for pump attachment. The pump drive shaft slides over and is keyed to the engine drive shaft and has an annular lip for mating with the thrust bearing. The pump wobble plate is bolted to the lower end of the pump drive shaft.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 3 is an enlarged, fragmentary, side elevational view, partly cut away and in vertical section, showing components coupling the engine and pump;

FIG. 4 is an enlarged, vertical sectional view of the pump drive shaft;

FIG. 5 is an enlarged, top plan view of the pump drive shaft taken along line 5—5 of FIG. 4;

FIG. 6 is an enlarged, bottom plan view of the pump drive shaft taken along line 6—6 of FIG. 4;

FIG. 7 is an enlarged, bottom plan view of the attachment flange; and

FIG. 8 is an enlarged, vertical sectional view of the attachment flange taken along line 8—8 of FIG. 7.

BEST MODE FOR CARRYING OUT THE INVENTION

Figure 1:
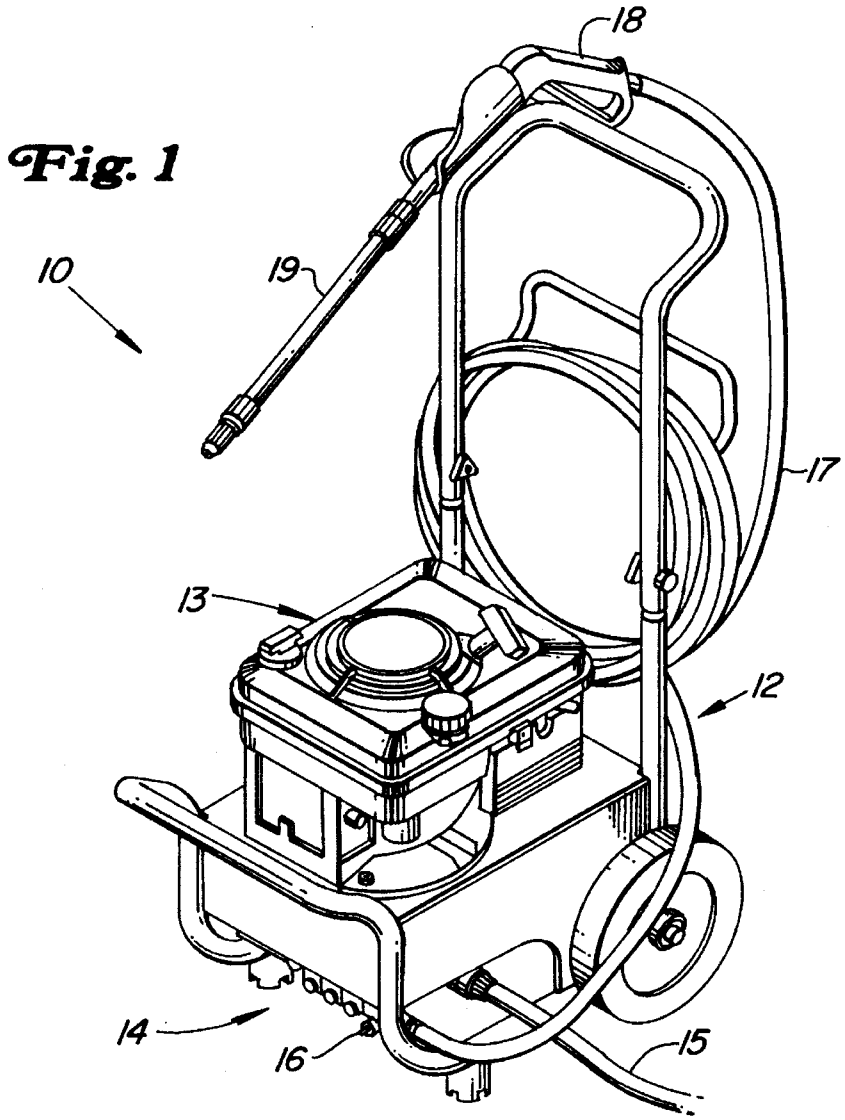
FIG. 1 is a partially fragmentary, perspective view of the pressure washer.

The vertical shaft pressure washer is shown generally at 10 in FIG. 1. A wheeled framework 12 supports a vertical shaft engine 13 coupled to an axial piston pump 14. The pump 14 is provided with water input 15, input 16 for detergent and the like, and an output coupled by hose 17 to a gun 18 with attached wand 19. Coupling of the engine 13 to the pump 14 is shown more specifically in FIGS. 2 and 3 with the coupling assembly 20 of the invention joining the engine 13 and pump 14.

Referring now to FIGS. 7 and 8, the coupling assembly 20 more particularly includes an upper peripheral engine attachment flange 24 and a lower pump attachment section A first annular side wall 26 depends from the inner edge of flange 24. The coupling assembly 20 further includes a generally planar bottom wall member 27. A plurality of attachment bores 28 are formed through, and spread about the periphery of the bottom wall 27. A large central bore 29 also is formed in and through wall 27. Annular wall 30 depends from the lower surface of bottom wall 27.

A second annular side wall 31 extends upwardly from bottom wall 27 and defines a central space 322. A third annular side wall 33 extends upwardly from wall 31 and defines a central space 34. A plurality of radially spread ribs 36 extend from flange part 24 to walls 27, 32 and 33 interconnecting the same. Passageways 37 are defined by the ribs 36 and wall members 27, 31 and 33. A vent port 38 is formed through at least one rib 36 to the central space The walls 26, 30, 31 and 33 and spaces 29, 32 and 34 are disposed coaxially along the vertical axis of the coupling assembly 20.

Referring next to FIGS. 4–6, the coupling assembly 20 includes a shaft means 40 with an upper hollow cylindrical end section 42. Opposed keyways 43 are formed into the interior wall surface of section 42 parallel to the axis thereof. An annular lip 44 extends from shaft 40 normal to the long axis thereof. A lower frustoconical end 46 tapers as it extends downwardly from the lip area 44. A threaded axial bore 47 is formed in lower end 46.

The pump attachment section 22 also includes an oil seal member 48, thrust bearing 50, and fixed to the depending engine drive shaft 52 either a Woodruff key 53, or a straight key 54, or multiple keys 53, 54. Refer to FIG. 3 for illustration of multiple key usage.

Figure 2:
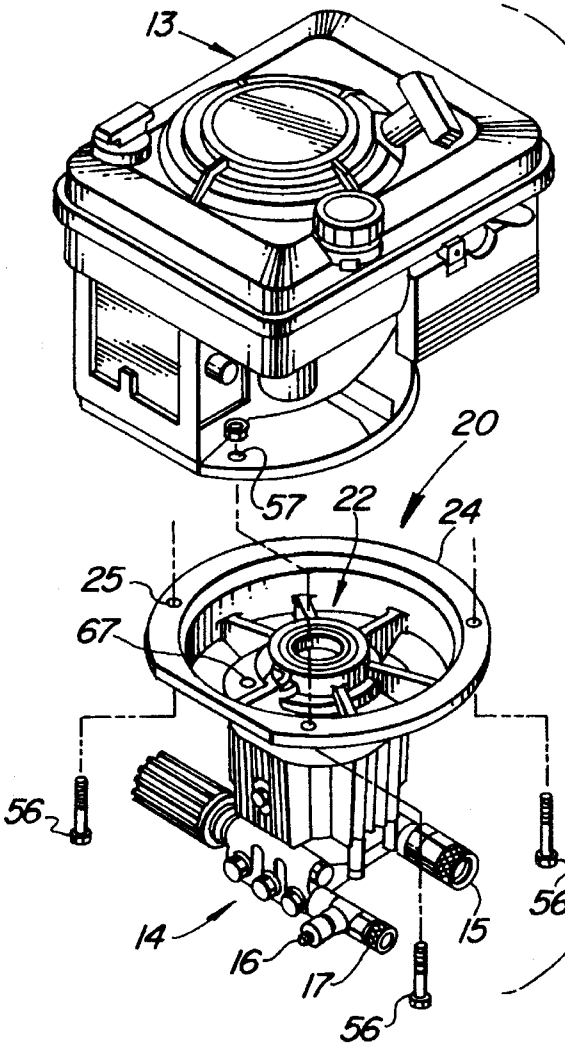
FIG. 2 is an enlarged, exploded perspective view better showing the components coupling the engine and pump.

The coupling unit 20 is mounted by bolts 56 through bores 25 and aligned engine bores 57 (see FIG. 2). The oil seal 48 is mounted at annular side wall 33. The thrust bearing 50 is mounted against side wall 31. The pump shaft 40 is oriented such that the keyways 43 are aligned with the keys 53, 54 then press fit into the thrust bearing 50 and the oil seal 48. See FIG. 3.

The pump wobble plate 61 slides onto the lower tapered end 46 and is held on the shaft 40 by the attachment bolt 63. The pump casing 65 is attached to bottom wall 27 by bolts 67 (FIG. 2) through bores 28 aligned with pump casing bores (not shown). The wobble plate bearing 69 and pump pistons 71 bear against the underside of wobble plate In operation, the engine 13 drive shaft 52, by the keys 53, 54, rotates the pump shaft 40, causing the wobble plate 61 to drive the pistons 71.

Proper oil levels are maintained and leakage prevented by the oil seal 48 and vent port 38. Excess oil pressure can be relieved by venting through the port 38, through the passageways 37, and out of the pressure washer coupling assembly. Air movement through the passageways 37 facilitates cooling of the engine 13. The annular lip 44 sits against the thrust bearing 50, supporting the shaft 40 and wobble plate 61 against the pistons 71. A more compact pressure washer, relatively easier to operate, results from implementation of the pressure washer coupling assembly. The industrial applicability of this invention is believed to be apparent from the foregoing description.

Obviously, many modifications and variations of the present invention are possible in light of the above teachings. It is therefore to be understood that, within the scope of the appended claims, the invention may be practiced otherwise than as specifically described.

What is claimed is:

1. In a vertical shaft pressure washer having a vertically oriented axial piston pump driven by an internal combustion engine with a downwardly extending drive shaft, an engine-pump mating assembly, comprising:

(a) an engine attachment flange;

(b) a pump attachment section, carried inward and below said engine attachment flange by a plurality of spaced-apart radial ribs extending therebetween, and having a concentrically stacked oil seal ring, thrust bearing ring, and pump attachment ring; and (c) shaft means, removably secured to said engine drive shaft and rotatable within said pump attachment section, for driving said axial piston pump.

2. The mating assembly as recited in claim 1, further comprising a pressure vent port within said pump attachment section.

3. The mating assembly as recited in claim 1, wherein said shaft means comprises an upper hollow cylindrical section for receiving said engine drive shaft therein, a central circular plate section having a diameter greater than that of the cylindrical section so as to form a lip for engaging said thrust bearing, and a lower, interiorly threaded frustoconical section for engaging a wobble plate of said axial piston pump.

* * * * *